United States Patent [19]

Perraud

[11] 4,105,081

[45] Aug. 8, 1978

[54] ROCK-DRILLING AND BOLT-SETTING APPARATUS

[75] Inventor: Raymond Jean Perraud, Villeurbanne, France

[73] Assignee: Societe d'Etude et de Construction de Machines pour Toutes Industries S.E.C.O.M.A.S.A., Villeurbanne, France

[21] Appl. No.: 754,990

[22] Filed: Dec. 28, 1976

[30] Foreign Application Priority Data

Dec. 30, 1975 [FR] France ..... 75 40426

[51] Int. Cl.[2] ..... E21B 9/24

[52] U.S. Cl. ..... 175/122; 173/18; 173/50; 173/147; 175/173; 175/381; 175/385

[58] Field of Search ..... 173/18, 11, 147, 50, 173/52, 45; 175/122, 220, 257, 389, 390, 381, 386, 173; 408/22, 36

[56] References Cited

U.S. PATENT DOCUMENTS

| | | | |
|---|---|---|---|
| Re. 8,155 | 4/1878 | Shoots | 408/36 |
| 2,964,115 | 12/1960 | Clatfelter | 175/220 X |
| 3,141,511 | 7/1964 | O'Leary | 173/52 X |
| 3,703,212 | 11/1972 | Abrahams | 173/52 X |
| 3,915,243 | 10/1975 | Hisey | 173/147 X |

*Primary Examiner*—Ernest R. Purser
*Assistant Examiner*—William F. Pate, III
*Attorney, Agent, or Firm*—Karl F. Ross

[57] ABSTRACT

A bolt-setting and rock-drilling apparatus has a rail which can be swung about and axis and axially displaced therealong to position a drilling carriage and a bolt-setting carriage alternately with respect to a rock wall in which the bolt is to be lodged. The carriages are slidable on opposite sides of the rail and, in the upper end thereof, in alignment with the drill holder, is an opening drill through which the main drill passes. The opening drill, which is of a configuration enabling it to form a conical mouth to the hole bored, by the main drill, is displaceable parallel to the main drill when its holder engages a clutch member carrying the opening drill. The conical mouth facilitates subsequent insertion of the bolt.

5 Claims, 4 Drawing Figures

ROCK-DRILLING AND BOLT-SETTING APPARATUS

The present invention relates to rock drilling and bolting apparatus which is used to secure bolts in the roof and walls of mine galleries to sustain the gallery.

The bolt-setting technique which has been used heretofore consists, after holes have been drilled in the roof, of placing in each of them a bolt having an end-piece which, by expansion, anchors itself at the bottom of the hole. Thereafter, tightening of the bolt causes compression of the ground structure forming a concentric column around the shank of the said bolt. Recent development of this technique replaces such bolts by resin-sealed shanks but three main operations still have to be carried out, i.e., the boring of the hole, the placing of the bolt and the tightening thereof.

An apparatus is known which is capable alone, and without having to be moved, of carrying out these three operations successively, by the mere pivoting of the apparatus around the axis of a rod anchored in the roof of the gallery. This drilling and bolting apparatus consists basically of a slide on which two carriages can move, one carriage being for drilling the hole and the other for inserting the bolt in the hole and tightening it up. The slide can swivel around the axis of the anchor-rod-shank in such a manner that after pivoting, the axis of the bolt corresponds to that of the hole bored immediately before effecting the placing of the bolt.

One difficulty encountered in using this apparatus is that of getting the axis of the bolt to coincide exactly with the center-line of the hole previously drilled, the diameter of the hole being slightly larger than that of the bolt. This difficulty becomes greater as the height of the gallery increases and the reasons for this are diverse: on the one hand, the anchorage may have been moved slightly and, further, numerous parts of the apparatus which move relative to each other are subject to wear, which gives rise to unavoidable play. Consequently the placing of the bolt, in practice, must often be done by a man positioned in a cabin, although the purpose of the apparatus is to eliminate any manual operation.

The object of the present invention is to overcome the above-mentioned problem and to facilitate the setting of the bolt in the drilled hole.

According to the present invention there is provided a rock drilling and bolting apparatus comprising a slide upon which can slide a first carriage for drilling a hole and a second carriage for inserting and locking a bolt in said hole, the slide being capable of pivoting around and sliding on an anchored rod so that in one position the longitudinal axis of the bolt is substantially aligned with the axis of the drilled hole. According to an essential feature of the invention the slide carries a drilling device which is coaxial with the drill bit of the first carriage and which can be used at the end of the drilling operation to widen conically the entrance of the drilled hole to facilitate the positioning of the bolt.

The drilling device comprises an opening bit located around and able to rotate and move longitudinally with respect of the drill bit, and capable of being driven round and thrust forward at the same time as the bit when the first carriage comes to the end of its travel.

This arrangement is particularly advantageous in that it avoids the use of an additional motor for the drive of the bit and it permits the drilling device to run atuomatically when the drilling carriage nears the end of its travel.

The drilling device is carried by a stop upon which rests a collar fixed to the bit until the drilling carriage comes to the end of its travel, the bit also having opposed coupling devices which operate together when the first carriage nears the end of its travel.

Thus, when the carriage has moved forward, the coupling device acts as a clutch which permits the drill carrier to actuate the bit in rotation, at the same time moving it from the retainer stop and forcing it to penetrate the rock while the drilling of the hole is being completed. This coupling device may be made in the form of a frictional clutch or otherwise.

The invention will now be described, by way of example, with reference to the accompanying drawing in which.

Figure 1:
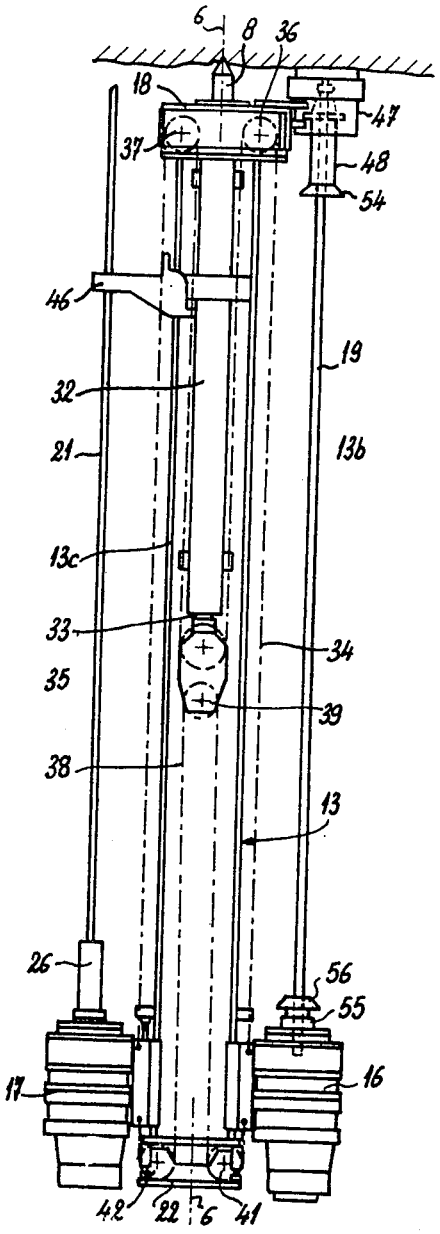
FIG. 1 is a side-elevation view of a rock-drilling and bolt-setting apparatus according to the present invention.

The gear is carried on an arm (not shown) so that is can swivel and slide with respect to a vertical axis 6 in the embodiment illustrated but which can adopt any desired angle with the vertical. Along this axis, the apparatus comprises a rod the upper end of which is pointed as at 8 by means of which the apparatus is anchored in the rock. The swivelling portion of the gear is primarily made up of a slide 13 of 'H' cross-section which extends parallel to the axis 6, and the flanges of which 13*b* and 13*c* act as slide rails for a drilling carriage 16 and a locking carriage 17 respectively.

The forward/backward movement of both carriages 16 and 17 along the slide 13 is effected solely by a ram 32 which depends by its base from a plate 18 carried at the top of slide 13 with its rod 33 extending downwards. A cable or muffled chain 34 passes over a pulley 35 set at the top of a pulley block of the shank 33 of the ram 32. Each end of the cable or chain 34 is attached to one of carriages 16 or 17 after passing over pulleys 36 and 37 respectively, which pulleys are carried by plate 18. When one or other of the carriages is halted and the rod 33 of the ram 32 descends the other carriage ascends at twice the speed of the shank 33. The withdrawal of the carriages 16 and 17 is effected by means of an inverse arrangement comprising a cable or chain 38 passing over a pulley 39 carried by the block of rod 33 of the ram 32.

The ends of the cable or chain 38 are connected to either carriage 16 or 17 and after passing over pulleys 41 and 42, are borne by member 22 which is fixed to the base of the slide 13. Thus, after rod 33 has been lifted, the carriage previously pulled upwards along slide 13 is brought back to its original position at the bottom of the latter.

The locking of one or other of the carriages 16 or 17 is effected by means of a bolt which locks the carriage in its lower position when the slide 13 is at one of the extreme angular positions of its swivelling-movement around axis 6. More exactly, when the slide 13 is in a position for boring, the locking carriage 17 is locked in the lower position and conversely, when slide 13 has swivelled and is in a locking position, it is the drilling carriage 16 which is locked in the lower position.

The rotary movement of a drill bit 19 and a casing 26 which carries bolt 21 are effected by means of two independent electric motors carried respectively on carriages 16 and 17. These movements may also be effected by means of a turning bar, from one or two stationary motors.

At its top, slide 13 also carries a guide-piece 46 through which passes the bolt 21, and a dust-collecting pot 47, the latter being fixed to plate 18 and placed along the axis of the bit 19, in such a way as to touch the roof of a gallery when the rock-bolting apparatus is in use.

All the items described up to now are already provided, in an identical or similar form, in existing devices.

In the present invention, plate 18 carries, in conjunction with the dust-collecting pot 47, a drilling device which consists principally of an opening bit 48 around the bit 19 which permits, on the opening of a drilled hole 44, the boring of a conical month 49 (see FIG. 3,) facilitating the positioning of a bolt 21.

Figure 4:
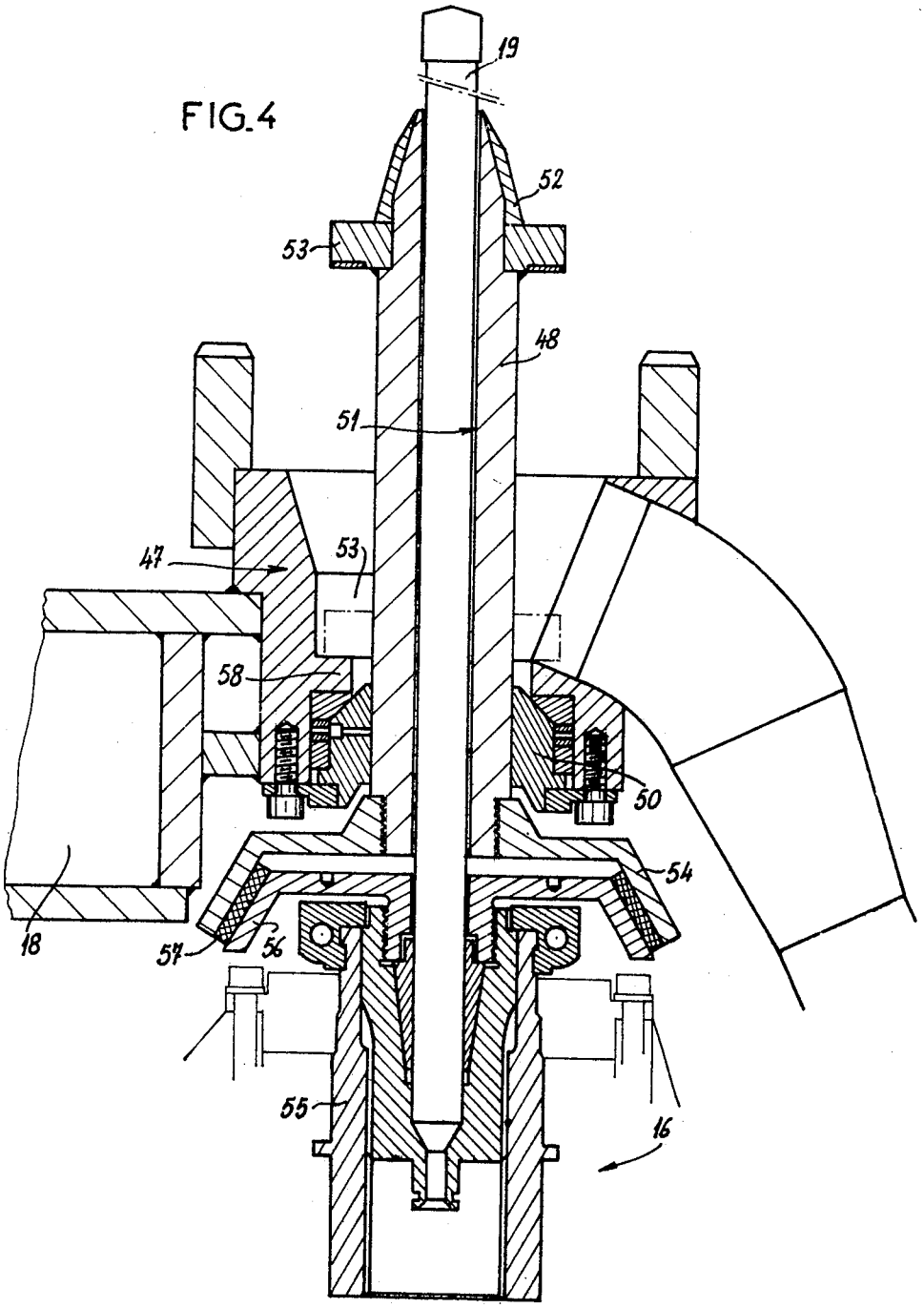
FIG. 4 is a cross-sectional drawn to an enlarged scale of a detail of the apparatus.

This drilling-device is shown in detail in FIG. 4. It comprises a support member 50 fixed to the plate 18 which member bears the opening bit 48. The tubular bit 48 has a longitudinal bore 51 into which the bit 19 fits. At the tip of the bit 48 is a conical portion 52 which allows rock to be cut and which is adjacent a collar 53. At its other end, the opening bit 48 carries a conically dished clutch plate 54.

A carrier 55 for the bit 19, which retains and rotates the latter, has a clutch-plate 56 opposite opposing the plate 54 in the upper position of slide 16 and of similar conicity. A friction lining 57 is provided between the plates 54 and 56.

The dust-collecting pot 47 comprises a stop 58 set below the collar 53 which acts as a supporting for the collar 53. This ensures the retention of the opening bit 48, when not in use, as is shown in FIGS. 1 and 2 as well as by the broken line in FIG. 4.

Figure 2:
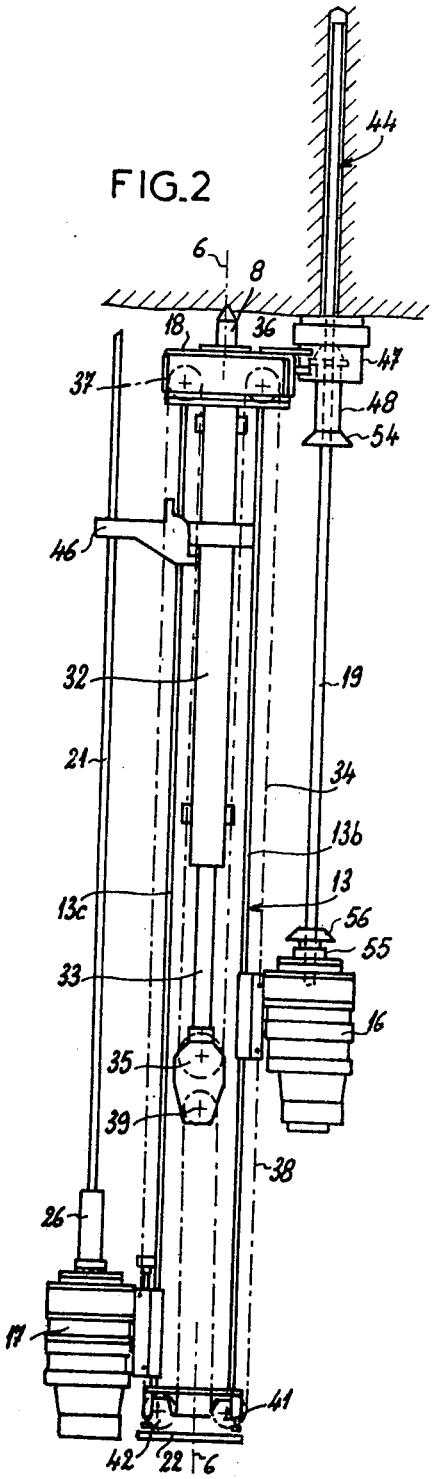
FIGS. 2 and 3 are elevations similar to FIG. 1, and show two stages in the operational cycle of the apparatus.
Figure 3:
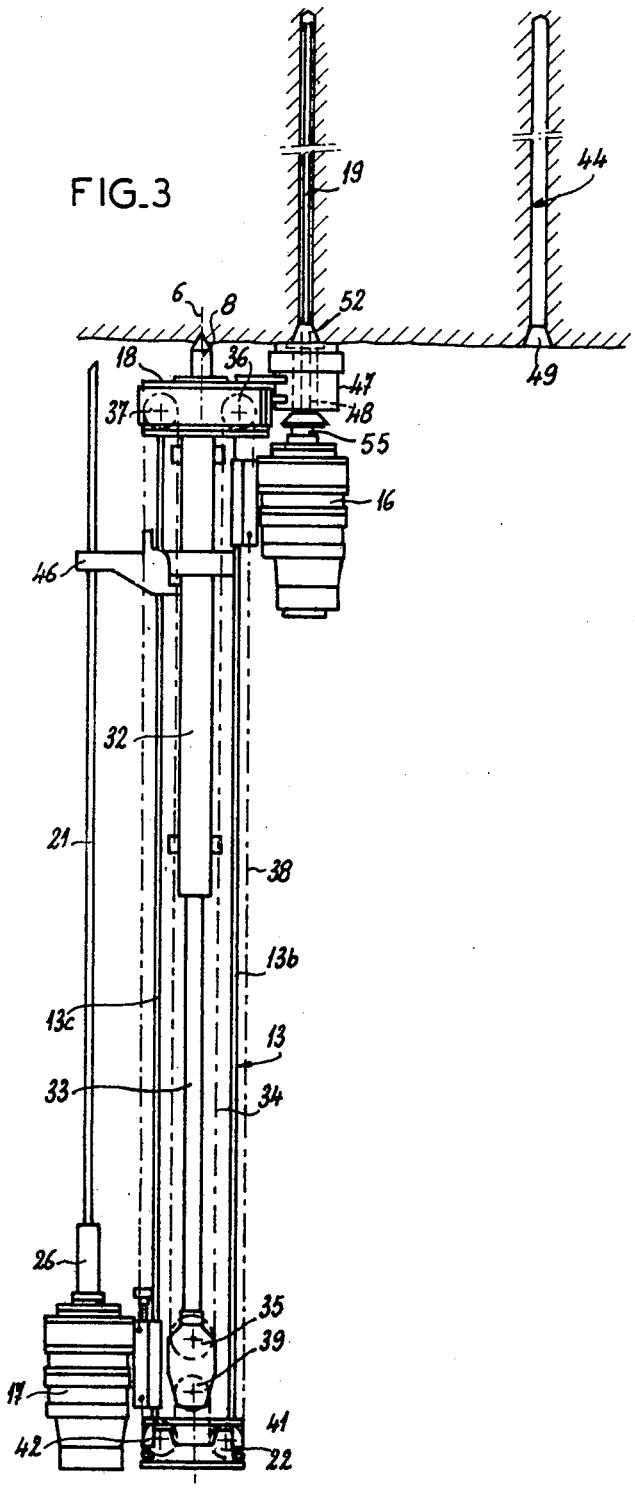

FIGS. 1, 2, and 3 show the working of the apparatus during drilling-operations, the bolting-operation not being shown since it is in no way different from that of known devices.

At the start of the cycle, the operator anchors the point 8 in the rock in a position which is dependent upon that which bolt 21 shall take and which will remain fixed throughout the cycle. Slide 13 is swivelled round the axis 6 and brought to its angular drilling position where the bit 19 is set towards the axis of the hole to be bored. By a sliding movement along the axis 6, the slide 13 is also raised until the dust-collecting pot 47 makes contact with the gallery-roof. Both carriages 16 and 17 are initially in their lower position (FIG. 1) but, taking into account the angular position of the slide 13, only the locking-carriage 17 is held in this position.

The motor driving bit 19 is then started and ram 32 is lowered so as to cause its rod 33 to emerge, in such a way that the drilling-carriage 16 moves upward and forces the bit 19 into the rock (FIG. 2).

During this phase, the bit 19 is rotationally and longitudinally guided by the opening bit 48 the collar 53 of which rests upon the stop 58. The bit 48 itself remains at a distance from the roof of the gallery and is not used.

When the carriage 16 has reached the end of its run, hole 44 is then drilled its full length and the bit 48 has shaped its conical entrance 49 (FIG. 3). The carriage is then reversed, the slide 13 lowered and pivoted round axis 6, the point 8 remaining anchored in the rock to form a fixed center-point, in such a manner that, after swivelling, bolt 21 is located exactly below the widened entrance of the hole 44.

The top of slide 13 is then again applied to the roof and bolting is effected by means of the second carriage 17.

The invention is specially applicable to expanding bolts, as the introduction of the bolt into the hole drilled is facilitated, but it is also applicable to the use of resin-sealed rods, as the introduction of the resin cartridge into the drilled hole is also facilitated.

It will be appreciated that different ways of driving the opening bit described above could be used, for example by using a toothed clutch or a claw clutch, possibly fitted with a synchronizing device to allow gradual engagement.

What we claim is:

1. A rock-drilling and bolting apparatus comprising a slide upon which can slide a first carriage for drilling a hole and a second carriage for inserting and locking a bolt in said hole, the slide being capable of pivoting around and sliding on an anchored rod so that in one position the longitudinal axis of the bolt is substantially aligned with the axis of the drilled hole, a drilling device which is coaxial with the drill bit of the first carriage and which can be used at the end of the drilling operation to widen conically the entrance of the drilled hole to facilitate the positioning of the bolt, said drilling device comprising an opening bit located around and able to rotate and move longitudinally in respect of the drill bit, and capable of being driven round and thrust forward at the same time as the bit when the first carriage comes to the end of its travel, said drilling device being carried by a stop upon which rests a collar fixed to the bit until the drilling carriage comes to the end of its travel, the bit also having opposed coupling devices which operate together when the first carriage nears the end of its travel, the coupling devices comprising a friction clutch.

2. A rock-drilling and bolting apparatus comprising a slide upon which can slide a first carriage for drilling a hole and a second carriage for inserting and locking a bolt in said hole, the slide being capable of pivoting around and sliding on an anchored rod so that in one position the longitudinal axis of the bolt is substantially aligned with the axis of the drilled hole, a drilling device which is coaxial with the drill bit of the first carriage and which can be used at the end of the drilling operation to widen conically the entrance of the drilled hole to facilitate the positioning of the bolt, said drilling device comprising an opening bit located around and able to rotate and move longitudinally in respect of the drill bit, and capable of being driven round and thrust forward at the same time as the bit when the first carriage comes to the end of its travel, said drilling device being carried by a stop upon which rests a collar fixed to the bit until the drilling carriage comes to the end of its travel, the bit also having opposed coupling devices which operate together when the first carriage nears the end of its travel, the coupling devices comprising a toothed or claw clutch.

3. A rock-drilling and bolt-setting apparatus comprising:

anchor means engageable with a wall in which a bolt is to be set and defining an axis;

an elongated slide extending parallel to said axis and shiftable therealong toward and away from said wall, said slide defining a pair of rails parallel to said axis;

a drilling carriage mounted on said slide and shiftable parallel to said axis along one of said rails, said drilling carriage being formed with a rotatable drill holder, and a main drill received in said holder for boring a hole through said wall at a predetermined location;

a bolt-setting carriage on said slide shiftable along the other of said rails and provided with means for setting a bolt in said hole, said slide being angularly displaceable about said axis to align said bolt-setting carriage with said hole and simultaneously disalign said drilling carriage therefrom; and opening-drill means on said slide for forming a conical mouth of said hole in said wall, said opening drill means including a support fixed to said slide in alignment with said one of said rails, and an opening drill rotatably and axially shiftable on said support and coaxial with said main drill while being formed with a conical tip engageable with said wall to form said mouth.

4. The apparatus in claim 3, further comprising cooperating means on said drilling carriage and on said opening-drill means for longitudinally displacing said opening drill upon said drilling carriage approaching the end of its travel toward said wall.

5. The apparatus defined in claim 4 wherein said cooperating means includes a first clutch annular member on said opening drill turned toward said drilling carriage and a second annular clutch member on said holder turned toward said first clutch member and adapted to entrain said first clutch member rotatably upon interengagement of said clutch members on advance of said drilling carriage toward the end of its travel in the direction of said wall.

* * * * *